United States Patent [19]

Sander

[11] Patent Number: 4,524,707

[45] Date of Patent: Jun. 25, 1985

[54] DEVICE FOR FEEDING AND SEWING A TRIMMING RIBBON TO A GARMENT PART

[75] Inventor: Wilfried Sander, Nurtingen, Fed. Rep. of Germany

[73] Assignee: Pfaff Industriemaschinen GmbH, Fed. Rep. of Germany

[21] Appl. No.: 587,367

[22] Filed: Mar. 8, 1984

[30] Foreign Application Priority Data

Mar. 17, 1983 [DE] Fed. Rep. of Germany ..... 3309607

[51] Int. Cl.[3] ..... D05B 35/04

[52] U.S. Cl. ..... 112/152

[58] Field of Search ..... 112/151, 152, 153, 137, 112/143

[56] References Cited

U.S. PATENT DOCUMENTS

| | | | |
|---|---|---|---|
| 669,806 | 3/1901 | Rathbun et al. | 112/152 |
| 1,155,920 | 10/1915 | Hall | 112/152 |
| 3,548,767 | 12/1970 | Williams | 112/152 X |
| 3,905,316 | 9/1975 | Mall | 112/153 |

FOREIGN PATENT DOCUMENTS

| | | | |
|---|---|---|---|
| 1586901 | 3/1981 | United Kingdom | 112/151 |

*Primary Examiner*—Werner H. Schroeder
*Assistant Examiner*—Andrew M. Falik
*Attorney, Agent, or Firm*—McGlew & Tuttle

[57] ABSTRACT

A device for feeding and sewing a knitted ribbon to the edge portion of garment parts of a mesh material, to be provided with a U-shaped border trimming. To secure the position of the upper portion of the folded ribbon, a horizontal separating element is provided adjacent the vertical guide web of the presser foot which is associated with a lifting web extending laterally of and spaced apart from the guide web ahead of the needle. In the area closely adjacent the needle, a hold-down adjustable in height is provided between the lifting web and the guide web. The guiding edge and the foot of the hold-down are provided at different levels in order to slightly stretch the material and spread apart the meshes of the border.

6 Claims, 9 Drawing Figures

DEVICE FOR FEEDING AND SEWING A TRIMMING RIBBON TO A GARMENT PART

FIELD AND BACKGROUND OF THE INVENTION

This invention relates in general to the construction of sewing machines and in particular to a new and useful device for feeding and sewing a trimming ribbon to a garment part.

A device for sewing a trimming ribbon to an edge of material is disclosed in German Pat. No. 11 20 852 corresponding to U.S. Pat. No. 2,940,406. In this prior art design, the horizontal projection provided on the side edge guide of the presser foot and the horizontal portion of the angle piece on the needle plate hold the upper and lower portions of the trimming ribbon folded to a U-section and the garment edge portion introduced therebetween separated from each other. The guide web and the vertical portion of the angle piece of the needle plate are used to guide the side edges of the upper and lower portions of the ribbon, while an adjustable guide bar is provided to guide the folded edge of the ribbon.

This is intended to prevent particularly wide trimming ribbons folded to a U-section, such as a ribbed knitted strip having a close-mesh and an open-mesh border, from being deformed on the neck or arm cutout of a knitted piece of garment, or on the waist rim of a knitted vest. To a large extent, this device is satisfactory. However, a curling of the outer mesh area adjacent the border cannot be prevented, and the outer meshes cannot be fed to the needle with a sufficient accuracy. To ensure a seizing of the marginal zones, the seam must be sewed at a distance of more than one mesh row from the outer edge, which unfavorably effects the aspect of the sewn area.

Since the open-mesh side edge strongly tends to curling, it was necessary in the manufacture of high quality garments to unite knitted trimming braids having an open-mesh border to the garment piece on straight or circular linking machines by a linking seam securing everyone of the outer meshes of the border. For this purpose, of course, every end mesh of both the upper and lower portions of the U-folded braid and of the garment part has to be engaged on the needles of the needle bar or ring of the machine individually, in a tedious and time consuming manual operation. Only, to be sure, the quality of such a linking seam is excellent, since every mesh is secured and the connection can be noticed only by a person well skilled in the art.

SUMMARY OF THE INVENTION

The invention is directed to a further development of a sewing device and feed mechanism, permitting the feeding of the upper portion of the trimming ribbon in a manner preventing the outer mesh rows from curling and to secure everyone of the meshes of the outer mesh row by the seam, so that the seam connecting the ribbon to the garment part has on the exposed side the aspect of a linking seam border.

In accordance with the invention, a device for feeding and sewing a U-shaped trimming ribbon to the edge of a garment comprises an apparatus associated with a presser foot which is engageable with the workpiece comprising U-shaped ribbon arranged over the edge of the garment. The construction includes a guide web carried by the presser foot which overlies the garment and secures the position of the lower portion of the ribbon in respect to the garment. A guide bar connected to and spaced laterally of the guide web includes a first vertically extending portion against which the edge of the ribbon is positioned and an additional vertically extending portion which extends parallel to the seam and provides a lifting edge over which the upper portion of the ribbon is moved and which is located before the stitching area of the reciprocating needle of the sewing machine. The construction includes a hold-down which is carried by the presser foot and engageable with the ribbon adjacent its folded edge directly adjacent the needle stitch forming area between the lifting edge and the guide web.

Accordingly, it is an object of the invention to provide an improved device for facilitating the sewing of a ribbon to a garment.

A further object of the invention is to provide a construction used in association with a sewing machine presser foot which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
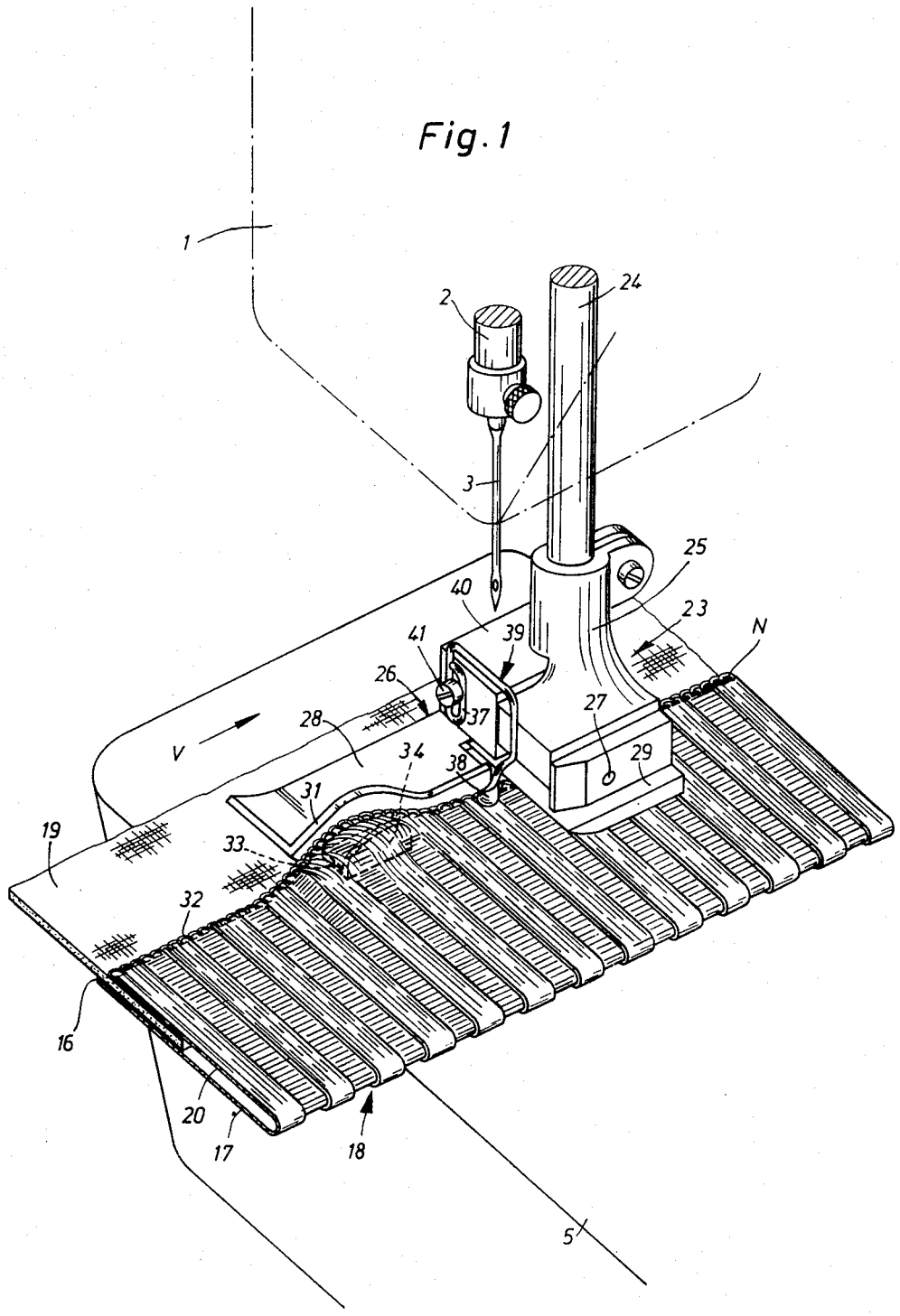
FIG. 1 is a perspective view of the sewing zone of a two-thread chainstitch sewing machine, with an enlarged view of an inserted workpiece.

Referring to the drawings in particular the invention embodied therein comprises a device for feeding and sewing a U-shaped trimming ribbon 18 which has an upper portion 20 overlapped upon a garment 19 and over a lower portion 16 which underlies the garment 19. In accordance with the invention, the apparatus is associated with a presser foot 23 which moves in cooperation with a reciprocating thread guiding needle 3 carried by a needle bar 2 to form stitches to secure the ribbon to the garment along an elastic seam designated N.

In accordance with the invention a needle plate over which the garment is fed includes an angle shaped guideway defined by a lug 14 and a shoulder 15 into which the lower portion of the ribbon extends and which secures the position of the edge of the lower portion of the ribbon. In addition, a guide web carried by the presser foot includes a horizontal part 28 overlying the garment 19 and a vertical guide web 31 which extends parallel to the seam and secures the position of the upper portion of the ribbon. The guide web also carries a guide bar which is spaced laterally of the vertical edge 31 and includes a vertically extending portion 34 which is substantially parallel to the seam and provides a lifting edge over which the upper portion of the ribbon is moved before it moves to the stitching area. The construction also includes a hold-down 39 which is carried by the presser foot and engageable with an edge portion of the ribbon directly adjacent the needle stitch forming area between the lifting edge 35 and the guide web 31.

Figure 8:
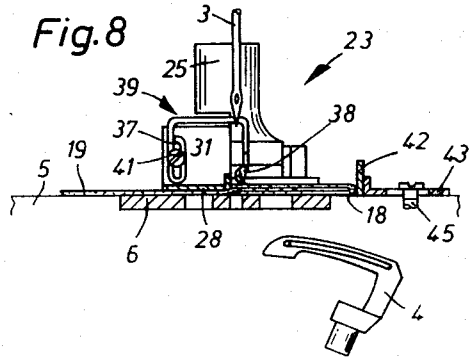
FIG. 8 is a sectional view taken along the line VIII—VIII of FIG. 6.
Figure 7:
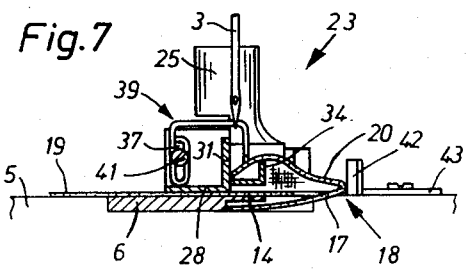
FIG. 7 is a sectional view taken along the line VII—VII of FIG. 6.
Figure 6:
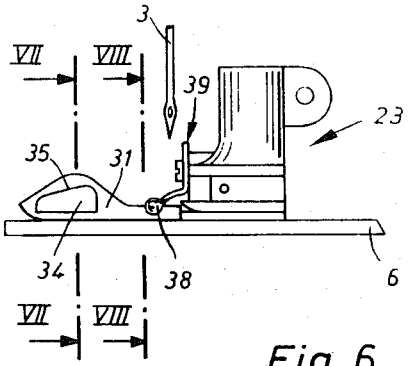
FIG. 6 is a side view of the presser foot.
Figure 3:
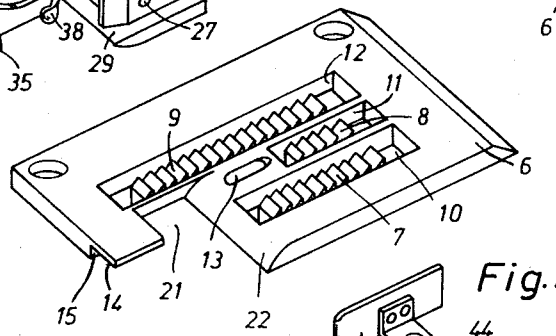
FIGS. 2,3 and 4 are perspective views; of the presser foot with a separating element comprising a lifting web, and a hold-down, of the needle plate and the legs of the feed dog, and of a guide bar for the folded edge of the trimming ribbon, about in actual size.

A two-thread chainstitch sewing machine for producing elastic seams N of the stitch type 401 according to DIN (German standard) 61400 particularly suitable for knitted goods and hosiery is generally indicated at 1. To form a seam, the thread guiding needle 3 secured to a reciprocating needle bar 2 cooperates in a known manner with a thread guiding looper 4, FIG. 8, which is mounted on the bed plate 5 of sewing machine 1, beneath needle plate 6. To effect the feed, the legs 7, 8, 9 of a conventional four-motion type feed dog protrude upwardly through needle plate slots 10,11,12. Needle plate 6 is further provided with a slot 13 for needle 3 and, at the work entrance edge, with a horizontal separating lug 14 and a shoulder 15 for guiding the border 16 of the lower portion 17. To enable the portion 17 of ribbon 18 to be shifted to the upper surface of needle plate 6, the needle plate is recessed at 21, FIG. 3, and the respective guiding edge portion 22 of recess 21 is curved.

The presser foot 23 of sewing machine 1 comprises a shank part 25 secured to the presser bar 24, and a sole part 26 which is hined to shank part 25 by a pin 27. The left hand portion 28 projecting against the feed direction (arrow V of FIG. 1) of sole part 26 is intended for clamping the garment part or workpiece 19, and the right hand portion 29 thereof which is elevated relative to needle plate 6 and extends behind needle 3 is intended for pressing the folded ribbon 18 against the respective feed dog legs 7. Due to the elevation of portion 29, the pressure on ribbon 18 is reduced, so that up to the instant needle 3 piereces the work, the operator is able to intervene manually. A bottom recess 30 of right hand portion 29 at portion 28 reduces the friction at the seam.

Left-hand or forward portion 28 of sole part 26 is provided with a vertically extending web 31 for guiding the open-mesh edge 32 of the upper portion 20 of ribbon 18. In FIG. 1, for reasons of clarity, the size of the outer meshes of edge 32 of the ribbon are exaggerated.

Figure 5:
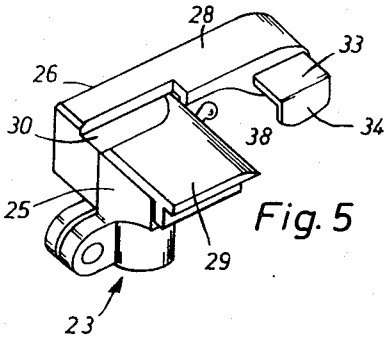
FIG. 5 is a bottom perspective view of the presser foot.
Figure 2:
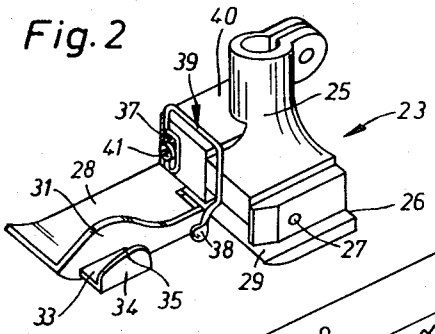
Figure 9:
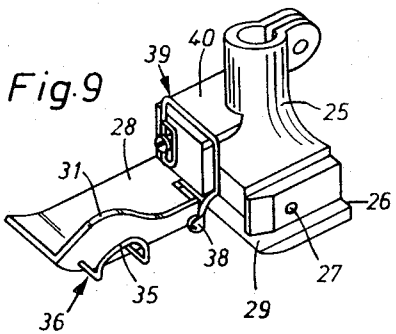
FIG. 9 is a view similar to FIG. 2 of the presser foot comprising a guide wire instead of the guide web.

At the entrance side of sole portion 28, a horizontal separating element 33 is secured, for example soldered, to vertical web 31. Element 33 comprises a vertical lifting web 34 which terminates upwardly with an arcuate guide edge 35 for the upper portion 20 of folded ribbon 18 and extends upstream of the stitch forming area and laterally spaced apart from guide web 31. As shown in FIG. 9, lifting web 34 or guide edge 35 may be embodied by a wire bracket 36. The horizontal portion of wire bracket 36 then replaces separating element 33, see also FIGS. 2 and 5.

A twice angled hold-down 39 for the border of upper portion 20 of ribbon 18, formed with an eye 37 and an enlarged foot 38, is secured by a screw 41 to the elevated heel portion 40 of the left-hand portion 28 of sole part 26. The foot 38 of hold-down 39 is provided closely adjacent to the piercing area of needle 3, between guide web 31 and lifting web 34, to prevent the outer meshes of the ribbon edge 32 from "fanning out" or "curling" and hold them flatly spread for the piercing stroke of needle 3.

Guide edge 35 and foot 28 of hold-down 39 are at different levels so that the upper portion 20 of folded ribbon 18 is fed first over upwardly sloping guide edge 35, so that the ribbon edge 32 becomes hump-backed and somewhat stretched in this zone whereby the meshes are enlarged, and then slopes arcuately down to the stitch forming area.

Figure 4:
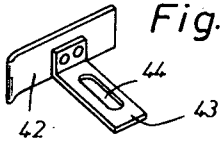

To guide folded edge of trimming ribbon 18, a guide bar 42 is provided, FIG. 4, comprising a holding lug 43 with an oblong slot 44 and being secured by a screw 45 to the supporting arm 5 of sewing machine 1.

The mechanism for feeding and sewing the trimming ribbon operates as follows:

The garment part 19 is placed by its edge below presser foot 23, to an extent ensuring a satisfactory bordering by ribbon 18. The knitted trimming ribbon 18 is folded to a U so as to have the folded edge at the outside, the lower leg or portion 17 of the U inserted below separating lug 14 and applying by its border against shoulders 15 to be fed through recess 21 and over edge portion 22 below the end of garment part 19 to the upper side of needle plate 6, and the upper leg or portion 20 inserted over the edge of garment part 19 beneath the right hand portion 29 of sole part 26 and below foot 38 of hold-down 39. Presser foot 23 is then lowered and the border or upper portion 20 of ribbon 18 is guided over guide edge 35 of lifting web 34, with the lateral edge 32 of the ribbon being applied against guide web 31.

Upon switching on the sewing machine, garment part 19 and ribbon 18 are moved by feed dog 7, 8, 9 in the feed direction, arrow V, in such steps that the seam N is formed by stitches which are shorter than the mutual spacing of the row widths of the parts 18 and 19 to be sewed together.

While being moved over guide edge 35 of the narrow vertical lifting web 34, the upper portion 20 of ribbon 18 is lifted in this zone and thereby slightly stretched along its path ahead of the stitch forming area, so that not only the border of upper portion 20 is uncurled as the outer meshes are spread along edge 32, but also a much more reliable guidance of upper portion 20 at guide web 31 is obtained due to the directional steadiness of the ribbon feed considerably improved by the guiding effect of lifting web 34.

Under the tension produced in ribbon 18 by the guidance over lifting web 34, the outer meshes of lateral edge 32 of upper portion 20 of ribbon 18 no longer can become curled again during the feed to the stitch forming area. They are in addition prevented from extending upright by the foot 38 of hold-down 39 which is adjustable to the material thickness, and are introduced to the needle in flatly spread state. This, and the selection of a stitch length smaller than the spacing of the meshes, makes sure that seam N will pick up all the meshes of lateral edge 32 of the ribbon.

If prepared annular trimming ribbons are sewed to garment part cutouts closed in advance, such as cutouts for the neck or arm, and waist rims of knitted goods, the upper portion 20 is removed from lifting web 34 shortly before reaching the seam stopping location, and is fed through the remaining small distance to the stitch forming area below the horizontal separating element 33. To secure this seam, barring stitches are made in the starting area of the seam, and this is followed by a thread cutting operation during which the sewing machine is stopped in the upper position of the needle, and presser foot 23 is lifted to permit removal and replacement of the work.

With very long trimming ribbons to be sewed, it is advisable to provide the ribbons or the garment parts with markings, either during their manufacture or later.

While a specific embodiment of the invention has been shown and described in detail ot illustrate the application of the principles of the invention, it will be understood that the invention may be embodied otherwise without departing from such principles.

What is claimed is:

1. A device for feeding and sewing a U-shaped trimming ribbon which has an upper portion overlapped upon the edge of a garment which is fed over a needle plate and with a ribbon lower portion underlying a margin of the garment forming with the garment a workpiece using a sewing machine having a reciprocating needle movable in a stitch forming area to effect a seam cooperating with a movable presser foot which is engageable with the workpiece to sew the ribbon to the garment along the seam, comprising an angle shaped guideway defined on the needle plate overlying and securing the position of the edge of the lower portion of the ribbon, a guide web carried by the presser foot extending parallel to the seam and overlying the garment for securing the position of the upper portion of ribbon, a guide bar connected to and spaced laterally of said guide web and including a vertically extending portion extending parallel to the seam and providing a lifting edge located before the stitch forming area over which the upper portion of the ribbon is moved, and a hold-down edge over which the upper portion of the ribbon is moved which is located before the stitch forming area, and a hold-down carried by the presser foot and engageable with the ribbon adjacent its folded edge directly adjacent the needle stitch forming area and between the lifting edge and said guide web.

2. A device according to claim 1, wherein said hold-down comprises a member mounted on the presser foot for vertical adjustable movement.

3. A device according to claim 1, wherein said lifting edge is defined by a wire bracket.

4. A device according to claim 1, wherein said presser foot includes a sole made in a single piece and has lower portion engageable with the garment and the raised portion forming said guide web.

5. A device according to claim 1, wherein said needle plate includes an edge extending parallel to the sewing direction with an inwardly extending recess, a leg extending outwardly in front of the recess along a transverse edge of said needle plate, said needle plate being curved along an edge extending into the recess to facilitate the positioning of the lower end of the ribbon therein.

6. A device according to claim 1, wherein said presser foot includes an elongated foot portion disposed in a lower plane engageable with the workpiece and a raised portion which overlies the upper part of the ribbon, said lower portion forming said guide bar having an upstanding edge forming said vertically extending portion extending parallel to the seam, said hold-down comprising a hold-down wire member secured to said presser foot including a leg portion extending downwardly for engagement against the upper portion of the ribbon.

* * * * *